US007249464B1

(12) United States Patent
Watson

(10) Patent No.: US 7,249,464 B1
(45) Date of Patent: Jul. 31, 2007

(54) THERMOELECTRIC-ACTUATED BACKPACK

(76) Inventor: Charles E. Watson, 3099 E. Normandy Park Dr., Apt. C2, Medina, OH (US) 44256

( * ) Notice: Subject to any disclaimer, the term of this patent is extended or adjusted under 35 U.S.C. 154(b) by 160 days.

(21) Appl. No.: 11/190,536

(22) Filed: Jul. 28, 2005

(51) Int. Cl.
*F25B 21/02* (2006.01)

(52) U.S. Cl. ..... 62/3.2; 62/259.3

(58) Field of Classification Search ..... 62/3.2, 62/3.6, 3.7, 259.3, 126, 314
See application file for complete search history.

(56) References Cited

U.S. PATENT DOCUMENTS

| | | | | |
|---|---|---|---|---|
| 3,096,702 | A | 7/1963 | Malone, Sr. et al. | |
| 4,449,378 | A * | 5/1984 | Thorpe | 62/371 |
| 4,687,414 | A | 8/1987 | Wardy | |
| 5,217,408 | A * | 6/1993 | Kaine | 454/338 |
| 5,304,035 | A | 4/1994 | Carter | |
| 5,909,802 | A * | 6/1999 | Puco et al. | 2/102 |
| 6,192,702 | B1 | 2/2001 | Shimogori | |
| 6,454,539 | B1 | 9/2002 | Santos | |
| 6,543,247 | B2 * | 4/2003 | Strauss | 62/259.3 |
| 6,625,814 | B1 * | 9/2003 | Veh | 2/102 |
| 6,666,647 | B1 | 12/2003 | Trask | |
| 6,915,641 | B2 * | 7/2005 | Harvie | 62/3.5 |
| D515,786 | S * | 2/2006 | Williamson | D2/830 |
| D516,777 | S * | 3/2006 | Beck | D2/829 |
| 7,107,629 | B2 * | 9/2006 | Miros et al. | 2/458 |
| 2002/0153126 | A1 * | 10/2002 | Clemente | 165/46 |

FOREIGN PATENT DOCUMENTS

JP 8-204077 A * 8/1996

* cited by examiner

*Primary Examiner*—Mohammad M. Ali

(57) ABSTRACT

A device includes a backpack that includes a cavity extending from a top to a bottom edge thereof. A fan is partially seated within the cavity and blows ambient air towards the operator. A heat sink is mated to the fan, disposed anterior thereof and is situated for allowing the air to pass therethrough. A thermal electric plate is conjoined to the heat sink. A thermal conductive plate is coupled to the thermal electric plate. An aluminum plate is conjoined to the thermal conductive plate. A first fastener is positioned through the heat sink, thermal electric plate and thermal conductive plate. Second and third fasteners are positioned through the aluminum and thermal conductive plates. A mechanism is included for supplying power to the fan and the thermal electric plate from a single power supply source.

18 Claims, 4 Drawing Sheets

THERMOELECTRIC-ACTUATED BACKPACK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cooling devices and, more particularly, to a thermoelectric-actuated backpack for cooling an operator's body.

2. Prior Art

Generally, fans used for personal cooling are designed for static use, i.e. the fan is placed in a desired location and plugged in an electrical outlet. However, a stationary fan, which must be plugged into an electrical outlet or mounted on a stationary support, cannot be readily used when outside, or if one is moving around away from the breeze generated by the fan. It would be desirable, such as when engaged in mobile outdoor activities in the summer (e.g., visiting recreational parks, going on picnics, etc.), to have the benefit of a fan's cooling breeze. Even when a person is indoors and moves around, away from a stationary fan, the cooling effect of the fan is lost.

The utility of existing fans which are capable of mobile usage is limited because the fans must either be manually held or attached to the wearer through an additional article of clothing (e.g., a hat). Continuously holding and manually directing a portable fan while moving around is much too burdensome to make such a fan effective for remaining cool. Furthermore, the activities the user can engage in are limited because the fan must be held in one hand. Mobile fans which are attached to clothing require the user to wear the additional clothing or forego the comfort of a fan. It is particularly undesirable to put on additional clothing, such as a hat, when indoors.

Accordingly, a need remains for a thermoelectric-actuated backpack in order to overcome the above-noted shortcomings. The present invention satisfies such a need by providing a thermoelectric-actuated backpack cooling device that is easy to use, small in size, and comfortable to wear. Such a device is easily worn on a hot summer's day and provides a localized cooling effect, thereby bringing relief from the heat, even when it is humid outside. The relative light weight and backpack styling of the thermoelectric-actuated backpack allows the device to be worn by and adjusted to persons with various physiques.

BRIEF SUMMARY OF THE INVENTION

In view of the foregoing background, it is therefore an object of the present invention to provide a thermoelectric-actuated backpack. These and other objects, features, and advantages of the invention are provided by a device for cooling an operator's body.

The device includes a back pack suitably sized and shaped for resting on an operator's shoulders wherein the back pack directly abuts an operator's back during use. Such a back pack includes a cavity extending from a top edge to a bottom edge thereof.

A rotary fan is partially seated within the cavity. Such a rotary fan is in fluid communication with ambient temperature such that the rotary fan advantageously and effectively blows a continuous air stream inwardly towards the operator.

A heat sink device is directly mated to the rotary fan and is disposed anterior thereof. Such a heat sink is conveniently and suitably situated for effectively allowing the air stream to pass therethrough. A thermal electric plate is directly conjoined to the heat sink and is in thermo contact therewith. Such a thermal electric plate may be sandwiched between the heat sink and the thermal conductive plate.

A thermal conductive plate is directly coupled to the thermal electric plate in such a manner that thermal energy can advantageously and effectively be passed through the thermal conductive plate and towards the operator's body. An aluminum plate is directly conjoined to the thermal conductive plate and extends along an entire longitudinal length of the cavity.

A first fastening member is threadably positioned through the heat sink, the thermal electric plate and the thermal conductive plate respectively. Second and third fastening members are threadably positioned through the aluminum plate and the thermal conductive plate respectively.

A mechanism is included for simultaneously supplying power to the rotary fan and the thermal electric plate from a single power supply source. The simultaneous power supplying mechanism preferably includes a control circuit, a transformer and a power cord electrically coupled thereto. Such a control circuit is operably connected to the transformer for allowing the operator to plug the power cord directly into a 12-volt power socket.

The heat sink thermally dissipates heat generated by the thermal electric plate and thereby effectively causes the thermal electric plate to operate at a cool temperature below the ambient temperature. The thermal conductive plate absorbs the cool temperature and thermally transfers the cool temperature to the aluminum plate such that the aluminum plate can advantageously and effectively cool the operator's body. The rotary fan simultaneously operates with the thermal electric plate, thereby cooling the heat sink during operating conditions.

The device preferably further includes an insulating layer sandwiched between the thermal electric plate and the aluminum plate. Such an insulating layer extends along an entire longitudinal length of the aluminum plate and is nested about the thermal conductive plate for advantageously prohibiting the cool temperature from rising beyond the ambient temperature. The thermal conductive plate and the insulating layer preferably have coextensive thicknesses. Such an insulating layer is preferably spaced from the heat sink so that undesirable heat can advantageously and effectively be dissipated away from the back pack.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
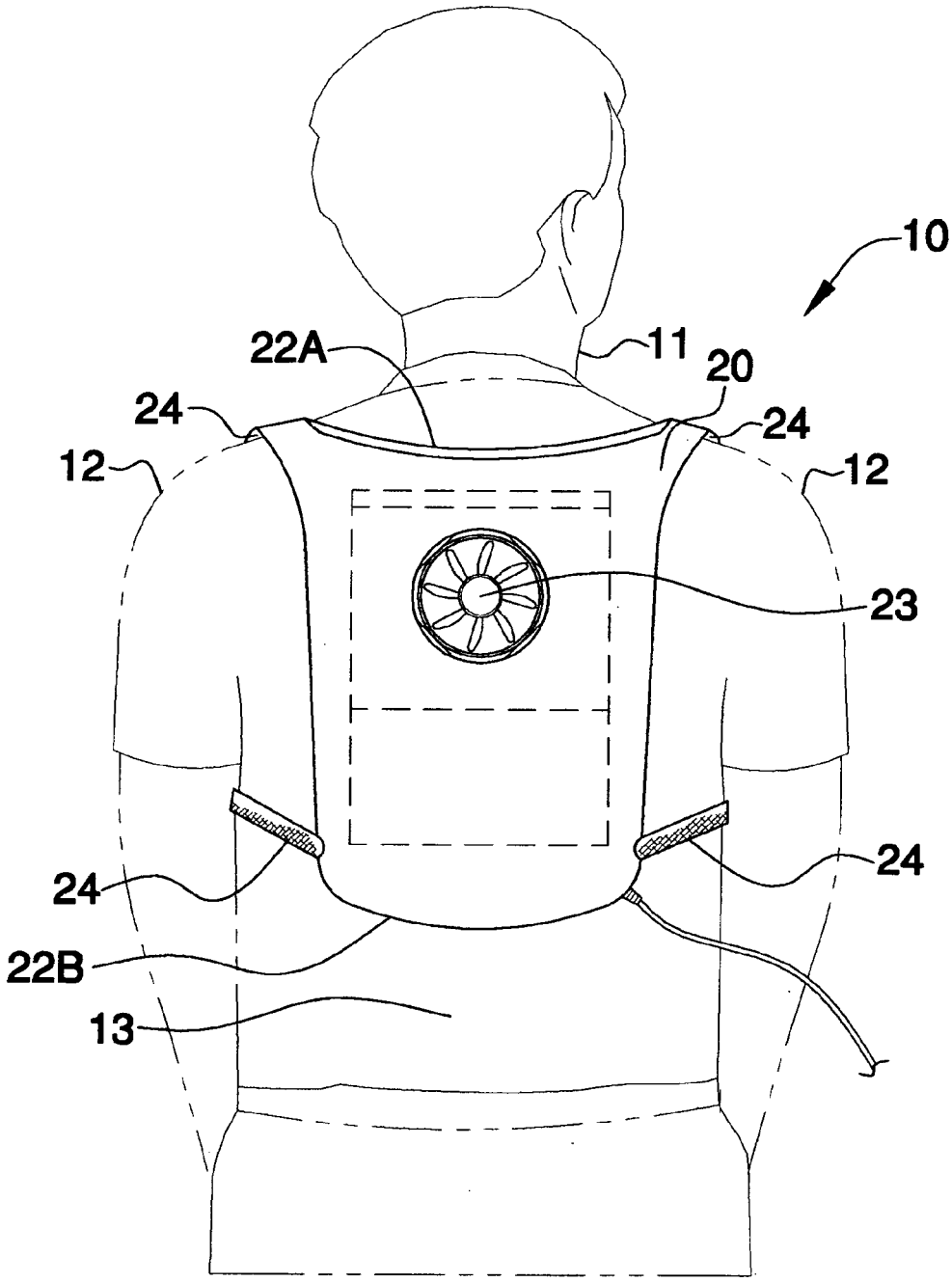
FIG. 1 is a front-elevational view showing a thermoelectric-actuated backpack, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-4 by the reference numeral 10 and is intended to provide a thermoelectric-actuated backpack. It should be understood that the device 10 may be used to cool many different body surfaces and should not be limited in use to only cooling a user's back region.

Referring initially to FIG. 1, the device 10 includes a backpack 20 suitably sized and shaped for resting on an operator's shoulders 12 wherein the backpack 20 directly abuts an operator's back 13 during use. Such a backpack 20 includes a cavity 21 extending from a top edge 22A to a bottom edge 22B thereof. Of course, the backpack 20 may be produced in a variety of different shapes and sizes so that persons of alternate physiques may all use the device 10, as is obvious to a person of ordinary skill in the art. The backpack 20 further includes a plurality of adjustable straps 24 attached to the top 22A and bottom 22B edges thereof. Such straps 24 are important and advantageous for allowing user to selectively adjust the backpack 20 to a position that is most comfortable for them.

Referring to FIGS. 1 through 4, a rotary fan 23 is partially seated within the cavity 21. Such a rotary fan 23 is in fluid communication with ambient temperature, which is essential such that the rotary fan 23 advantageously and effectively blows a continuous air stream inwardly towards the operator 11.

Figure 2:
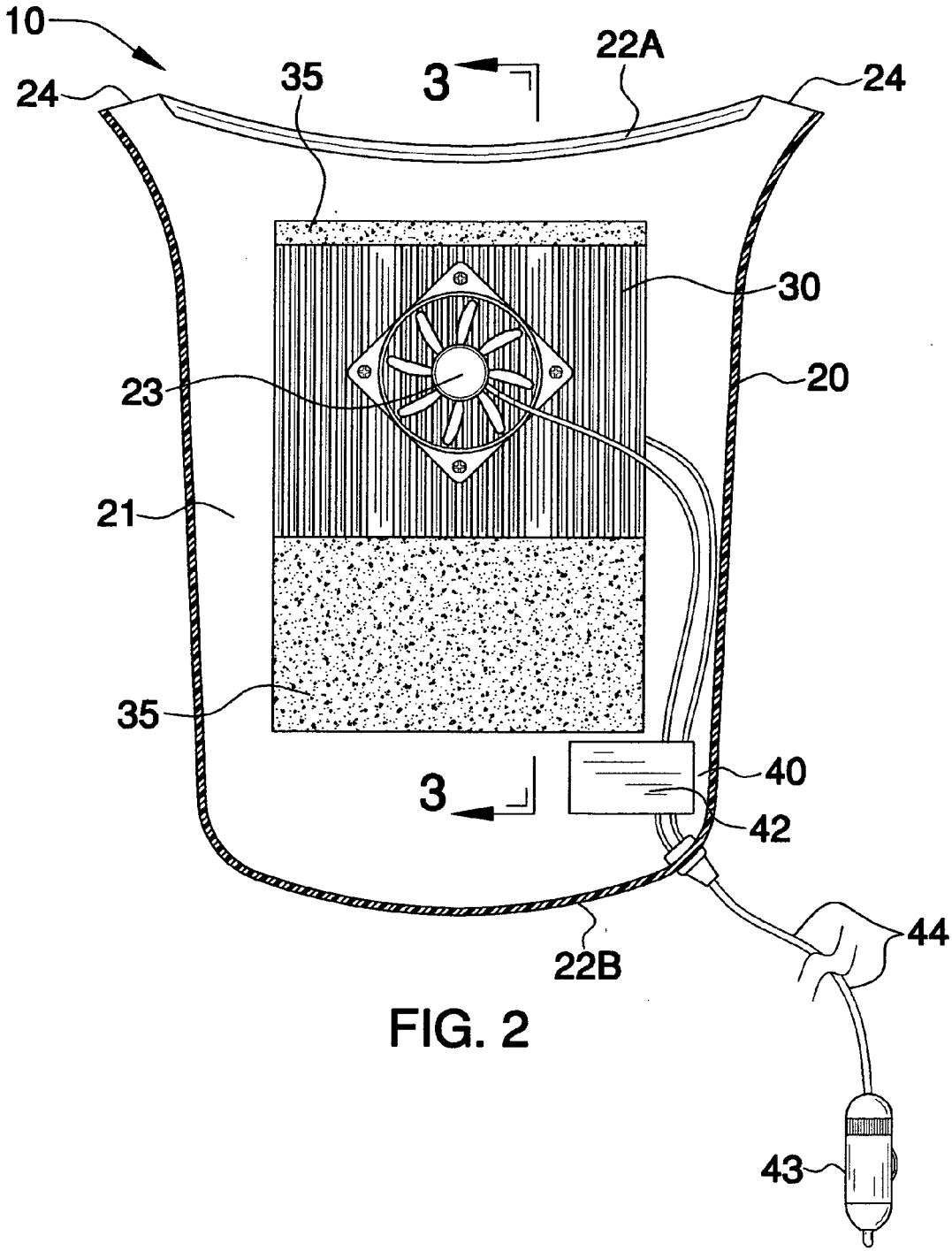
FIG. 2 is a cross-sectional view of the device shown in FIG. 1.
Figure 3:
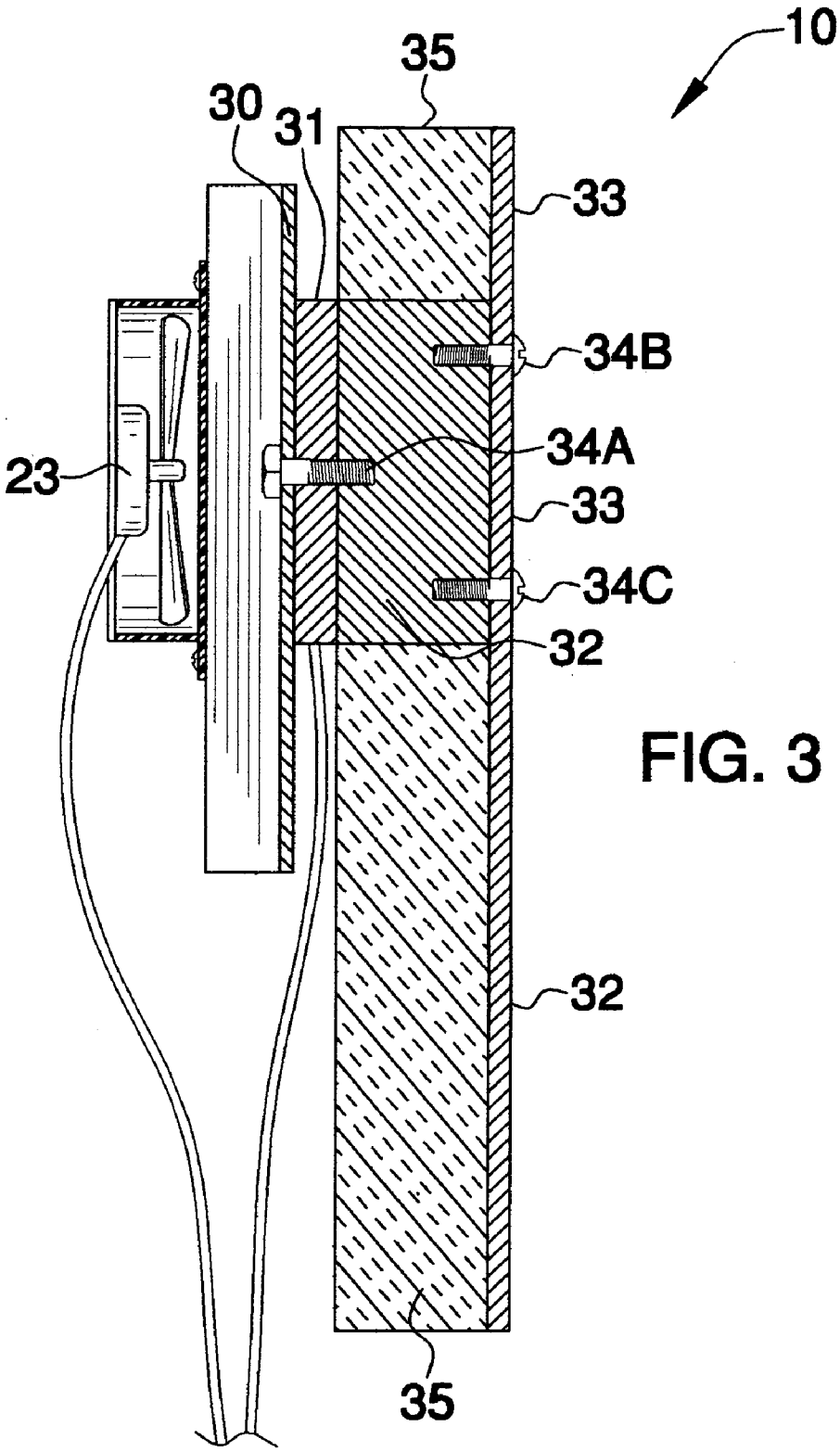
FIG. 3 is a cross-sectional view of the device shown in FIG. 2, taken along line 3-3.

Referring to FIGS. 2 and 3, a heat sink device 30 is directly mated, with no intervening elements, to the rotary fan 23 and is disposed anterior thereof. Such a heat sink 30 is conveniently and suitably situated for effectively allowing the air stream to pass therethrough. A thermal electric plate 31 is directly conjoined, with no intervening elements, to the heat sink 30 and is in thermo contact therewith. Such a thermal electric plate 31 is sandwiched between the heat sink 30 and the thermal conductive plate 32 (described herein below).

Referring to FIG. 3, a thermal conductive plate 32 is directly coupled, with no intervening elements, to the thermal electric plate 31 in such a manner that is essential for allowing thermal energy to advantageously and effectively pass through the thermal conductive plate 32 and towards the operator's body. An aluminum plate 33 is directly conjoined, with no intervening elements, to the thermal conductive plate 32 and extends along an entire longitudinal length of the cavity 21.

Still referring to FIG. 3, a first fastening member 34A is threadably positioned through the heat sink 30, the thermal electric plate 31 and the thermal conductive plate 32 respectively. Second 34B and third 34C fastening members are threadably positioned through the aluminum plate 33 and the thermal conductive plate 32 respectively. Such fastening members 34 are advantageous and important for ensuring that the heat sink 30, the thermal electric plate 31, the thermal conductive plate 32 and the aluminum plate 33 remain in direct contact with each other such that heat can effectively be transferred between those components.

Figure 4:
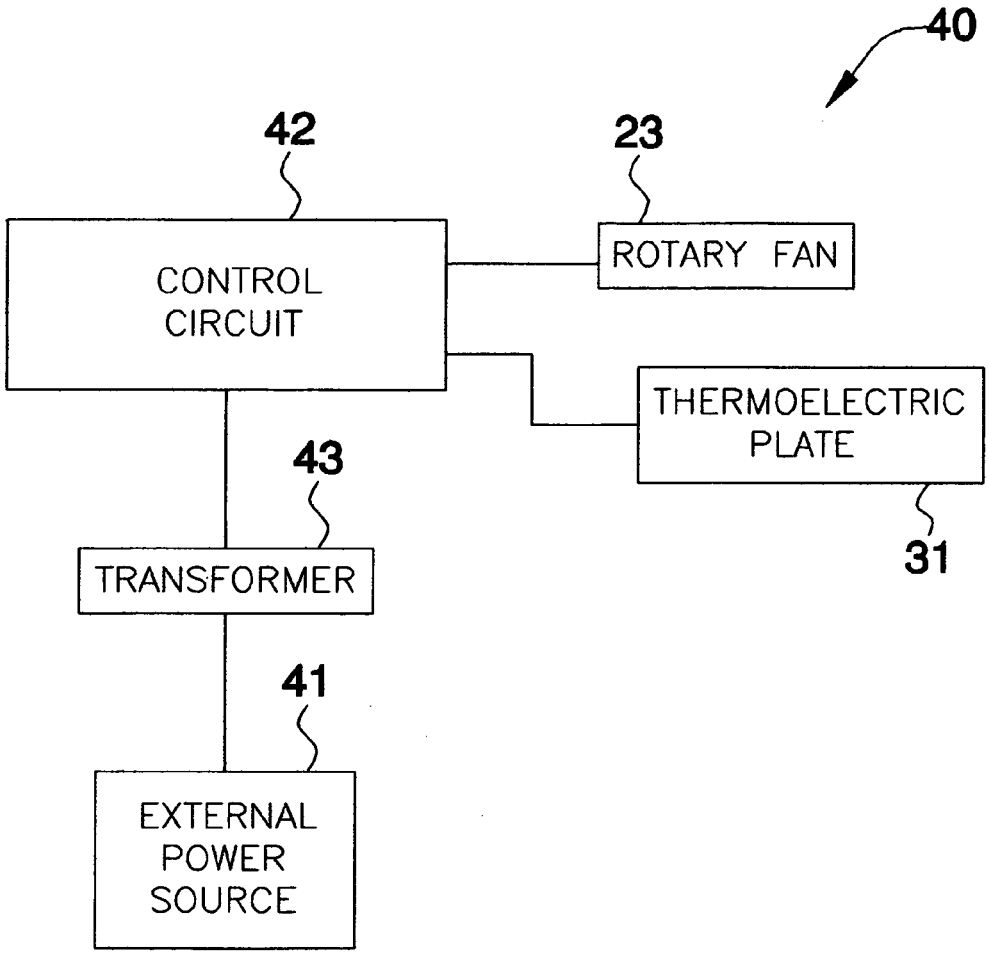
FIG. 4 is a schematic block diagram of the simultaneous power supplying mechanism shown in FIG. 1.

Referring to FIGS. 2 and 4, a mechanism 40 is included for simultaneously supplying power to the rotary fan 23 and the thermal electric plate 31 from a single power supply source 41. The simultaneous power supplying mechanism 40 includes a control circuit 42, a transformer 43 and a power cord 44 electrically coupled thereto. Such a control circuit 42 is operably connected to the transformer 43, which is crucial for allowing the operator to conveniently plug the power cord 44 directly into a 12-volt power socket (not shown).

In use, the heat sink 30 thermally dissipates heat generated by the thermal electric plate 31 and thereby effectively causes the thermal electric plate 31 to operate at a cool temperature below the ambient temperature. The thermal conductive plate 32 absorbs the cool temperature and thermally transfers the cool temperature to the aluminum plate 33, which is vital such that the aluminum plate 33 can advantageously and effectively cool the operator's body. The rotary fan 23 simultaneously operates with the thermal electric plate 31, thereby continuously cooling the heat sink 30 during operating conditions. This feature is advantageous and crucial for ensuring that a heat retaining capacity of the heat sink 30 is not exceeded, which would negatively affect the cooling ability of the device 10.

Referring to FIGS. 2 and 3, the device 10 further includes an insulating layer 35 sandwiched between the thermal electric plate 31 and the aluminum plate 33. Such an insulating layer 35 extends along an entire longitudinal length of the aluminum plate 33 and is nested about the thermal conductive plate 32 for advantageously prohibiting the cool temperature from rising beyond the ambient temperature. The thermal conductive plate 32 and the insulating layer 35 have coextensive thicknesses, which is critical for ensuring complete insulation of the thermal conductive plate 32. Such an insulating layer 35 is spaced from the heat sink 30, which is essential so that undesirable heat can advantageously and effectively be dissipated away from the backpack 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A device for cooling an operator's body, said device comprising:

a backpack suitably sized and shaped for resting on an operator's shoulders wherein said backpack directly abuts an operator's back during use, said backpack including a cavity extending from a top edge to a bottom edge thereof;

a rotary fan partially seated within the cavity, said rotary fan being in fluid communication with ambient temperature such that said rotary fan blows a continuous air stream inwardly towards the operator;

a heat sink device directly mated to said rotary fan and disposed anterior thereof, said heat sink being suitably situated for allowing the air stream to pass therethrough;

a thermal electric plate directly conjoined to said heat sink and being in thermo contact therewith;

a thermal conductive plate directly coupled to said thermal electric plate in such a manner that thermal energy can be passed through said thermal conductive plate and towards the operator's body;

an aluminum plate directly conjoined to said thermal conductive plate and extending along an entire longitudinal length of the cavity; and means for simultaneously supplying power to said rotary fan and said thermal electric plate from a single power supply source;

wherein said heat sink thermally dissipates heat generated by said thermal electric plate and thereby causes said thermal electric plate to operate at a cool temperature below the ambient temperature, said thermal conductive plate absorbing the cool temperature and thermally transferring the cool temperature to said aluminum plate such that said aluminum plate can cool the operator's body, said rotary fan simultaneously operating with said thermal electric plate and thereby cooling said heat sink during operating conditions.

2. The device of claim 1, further comprising: an insulating layer sandwiched between said thermal electric plate and said aluminum plate, said insulating layer extending along an entire longitudinal length of said aluminum plate and nested about said thermal conductive plate for prohibiting the cool temperature from rising beyond the ambient temperature.

3. The device of claim 2, wherein said thermal conductive plate and said insulating layer have coextensive thicknesses.

4. The device of claim 1, wherein said thermal electric plate is sandwiched between said heat sink and said thermal conductive plate.

5. The device of claim 1, wherein said simultaneous power supplying means comprises:

a control circuit;

a transformer and a power cord electrically coupled thereto;

wherein said control circuit is operably connected to said transformer for allowing the operator to plug said power cord directly into a 12-volt power socket.

6. The device of claim 2, wherein said insulating layer is spaced from said heat sink so that undesirable heat can be dissipated away from said backpack.

7. A device for cooling an operator's body, said device comprising:

a backpack suitably sized and shaped for resting on an operator's shoulders wherein said backpack directly abuts an operator's back during use, said backpack including a cavity extending from a top edge to a bottom edge thereof;

a rotary fan partially seated within the cavity, said rotary fan being in fluid communication with ambient temperature such that said rotary fan blows a continuous air stream inwardly towards the operator;

a heat sink device directly mated to said rotary fan and disposed anterior thereof, said heat sink being suitably situated for allowing the air stream to pass therethrough;

a thermal electric plate directly conjoined to said heat sink and being in thermo contact therewith;

a thermal conductive plate directly coupled to said thermal electric plate in such a manner that thermal energy can be passed through said thermal conductive plate and towards the operator's body;

an aluminum plate directly conjoined to said thermal conductive plate and extending along an entire longitudinal length of the cavity;

a first fastening member threadably positioned through said heat sink, said thermal electric plate and said thermal conductive plate respectively; and means for simultaneously supplying power to said rotary fan and said thermal electric plate from a single power supply source;

wherein said heat sink thermally dissipates heat generated by said thermal electric plate and thereby causes said thermal electric plate to operate at a cool temperature below the ambient temperature, said thermal conductive plate absorbing the cool temperature and thermally transferring the cool temperature to said aluminum plate such that said aluminum plate can cool the operator's body, said rotary fan simultaneously operating with said thermal electric plate and thereby cooling said heat sink during operating conditions.

8. The device of claim 7, further comprising: an insulating layer sandwiched between said thermal electric plate and said aluminum plate, said insulating layer extending along an entire longitudinal length of said aluminum plate and nested about said thermal conductive plate for prohibiting the cool temperature from rising beyond the ambient temperature.

9. The device of claim 8, wherein said thermal conductive plate and said insulating layer have coextensive thicknesses.

10. The device of claim 7, wherein said thermal electric plate is sandwiched between said heat sink and said thermal conductive plate.

11. The device of claim 7, wherein said simultaneous power supplying means comprises:

a control circuit;

a transformer and a power cord electrically coupled thereto;

wherein said control circuit is operably connected to said transformer for allowing the operator to plug said power cord directly into a 12-volt power socket.

12. The device of claim 8, wherein said insulating layer is spaced from said heat sink so that undesirable heat can be dissipated away from said backpack.

13. A device for cooling an operator's body, said device comprising:

a backpack suitably sized and shaped for resting on an operator's shoulders wherein said backpack directly abuts an operator's back during use, said backpack including a cavity extending from a top edge to a bottom edge thereof;

a rotary fan partially seated within the cavity, said rotary fan being in fluid communication with ambient temperature such that said rotary fan blows a continuous air stream inwardly towards the operator;

a heat sink device directly mated to said rotary fan and disposed anterior thereof, said heat sink being suitably situated for allowing the air stream to pass therethrough;

a thermal electric plate directly conjoined to said heat sink and being in thermo contact therewith;

a thermal conductive plate directly coupled to said thermal electric plate in such a manner that thermal energy can be passed through said thermal conductive plate and towards the operator's body;

an aluminum plate directly conjoined to said thermal conductive plate and extending along an entire longitudinal length of the cavity;

a first fastening member threadably positioned through said heat sink, said thermal electric plate and said thermal conductive plate respectively;

second and third fastening members threadably positioned through said aluminum plate and said thermal conductive plate respectively; and means for simultaneously supplying power to said rotary fan and said thermal electric plate from a single power supply source;

wherein said heat sink thermally dissipates heat generated by said thermal electric plate and thereby causes said thermal electric plate to operate at a cool temperature below the ambient temperature, said thermal conductive plate absorbing the cool temperature and thermally transferring the cool temperature to said aluminum plate such that said aluminum plate can cool the operator's body, said rotary fan simultaneously operating with said thermal electric plate and thereby cooling said heat sink during operating conditions.

14. The device of claim 13, further comprising: an insulating layer sandwiched between said thermal electric plate and said aluminum plate, said insulating layer extending along an entire longitudinal length of said aluminum plate and nested about said thermal conductive plate for prohibiting the cool temperature from rising beyond the ambient temperature.

15. The device of claim 14, wherein said thermal conductive plate and said insulating layer have coextensive thicknesses.

16. The device of claim 13, wherein said thermal electric plate is sandwiched between said heat sink and said thermal conductive plate.

17. The device of claim 13, wherein said simultaneous power supplying means comprises:

a control circuit;

a transformer and a power cord electrically coupled thereto;

wherein said control circuit is operably connected to said transformer for allowing the operator to plug said power cord directly into a 12-volt power socket.

18. The device of claim 14, wherein said insulating layer is spaced from said heat sink so that undesirable heat can be dissipated away from said backpack.

* * * * *